United States Patent [19]

Rodriguez

[11] 4,363,737

[45] Dec. 14, 1982

[54] LUBRICATION PASTES

[76] Inventor: Alvaro Rodriguez, Calle 126 A No. 36-A-36, Bogota, Colombia

[21] Appl. No.: 273,656

[22] Filed: Jun. 15, 1981

[51] Int. Cl.[3] ..... C10M 5/02; C10M 7/02

[52] U.S. Cl. ..... 252/26; 252/19

[58] Field of Search ..... 252/19, 26

[56] References Cited

U.S. PATENT DOCUMENTS

| | | | |
|---|---|---|---|
| 2,383,148 | 8/1945 | Morgan et al. | 252/19 |
| 3,232,872 | 2/1966 | Kohn | 252/19 |
| 3,239,288 | 3/1966 | Campbell et al. | 252/26 X |
| 3,423,315 | 1/1969 | McCarthy et al. | 252/19 |
| 3,652,414 | 3/1972 | Bergeron | 252/19 |
| 3,853,602 | 12/1974 | Nakamura | 252/26 X |
| 3,954,479 | 5/1976 | Jahn | 52/26 X |
| 4,243,728 | 1/1981 | Sato et al. | 252/26 X |

FOREIGN PATENT DOCUMENTS

| | | | |
|---|---|---|---|
| 5410304 | 6/1977 | Japan | 252/26 |

*Primary Examiner*—Paul F. Shaver

*Attorney, Agent, or Firm*—Jack E. Dominik

[57] ABSTRACT

Disclosed is a family of lubricants which are paste mixtures of powdered metals and oils or greases. These lubricants can be applied to gears, bearings, etc. by simple brushing on spraying on due to their pasty texture. And their adherence and longevity provide adequate lubrication with periodic applications as infrequently as once per week. Further, these lubricants possess good high temperature, high pressure, and corrosion resistance characteristics.

14 Claims, No Drawings

LUBRICATION PASTES

BACKGROUND OF THE INVENTION

1. Field of the Invention

This invention relates to solid lubricants and, more particularly, to metal-containing lubrication pastes.

2. Description of the Prior Art

There are many known metal-containing lubricants including dry lubricants such as molybdenum disulfide and "self-lubricating" parts. For example, U.S. Pat. No. 4,221,828 discloses a method for copper coating powdered metal disulfides with the resultant composite powder a desirable material for compressing, sintering, and impregnating with oil to form self-lubricating parts. U.S. Pat. No. 3,239,288 discloses self-lubricating materials based on molybdenum disulfide and titanium dioxide.

However, the known metal-containing lubricants are not practical for many uses such as with high pressures, high temperatures, and generally hostile environments. For example, exposed gears, such as catherine wheels used in cement kilns, are frequently lubricated by erecting an oil-spraying apparatus to continuously supply oil to the gears. The expense and reliability problems of such a system are apparent and are overcome by the applicant's invention.

SUMMARY OF THE INVENTION

Applicant's invention provides a family of lubricants which are paste mixtures of powdered metals and oils or greases. These lubricants can be applied to gears, bearings, etc. by simple brushing on spraying on due to their pasty texture. And their adherence and longevity provide adequate lubrication with periodic applications as infrequently as once per week. Further, these lubricants possess good high temperature, high pressure, and corrosion resistance characteristics.

It is an object of the invention to provide a new family of solid lubricants which will reduce the expenses of and increase the reliability of lubrication in hostile environments such as for catherine wheels in cement kilns.

DESCRIPTION OF PREFERRED EMBODIMENTS

The inventive lubrication pastes are made by thoroughly mixing the solid components, which have been powdered, with the fluid components.

The pastes are preferably applied as follows:

(1) The apparatus to be lubricated is first cleaned to remove all conventional lubricants;

(2) an initial coating of paste is brushed onto the appropriate friction surfaces of the apparatus;

(3) the apparatus is briefly operated, it is believed that this strengthens the lubrication film;

(4) a second coating is applied by any convenient means such as an electric pulverization pistol, and the apparatus is ready for operation. Further coatings are periodically applied as necessary, which may be as infrequently as once per week.

The solid components are selected from the group consisting of nickel, copper, graphite, molybdenum disulfide, aluminum, iron, borax, boron nitrate, silver sulfate, and tungsten disulfide. The fluid components are selected from the group consisting of silicon oil; mineral oil; naphthenic oil; paraffinic oil; vegetable oil; synthetic oil-no carbon; water-soluble oil; petroleum distillates; phenyl polysiloxane; polyglycol compounds; silicate esters; fluoride compounds; lithium soap.

Examples of pastes with desirable characteristics follow:

| Component | Percent by weight |
|---|---|
| Composition No. 1 | |
| Nickel | 90 |
| Chlorophenyl Silicon Oil (specific gravity 1.040 and viscosity 75 centistokes at 25° C.) | 10 |
| Composition No. 2 | |
| Nickel (Ni) | 80 |
| Mineral oil | 15 |
| Phenylpolysiloxane Silicon oil | 5 |
| Composition No. 3 | |
| Nickel (Ni) | 70 |
| Lithium soap | 10 |
| Naphthenic (cycloparaffinic) oil | 10 |
| Composition No. 4 | |
| Nickel (Ni) | 60 |
| Polyglycols | 20 |
| Paraffinic oil | 20 |
| Composition No. 5 | |
| Nickel (Ni) | 50 |
| Silicate esters (esters of $Si(OH)_4$) | 30 |
| Vegetable oil | 20 |
| Composition No. 6 | |
| Nickel (Ni) | 40 |
| Fluorides | 60 |
| Composition No. 7 | |
| Copper (Cu) | 30 to 60 |
| Nickel | 20 to 80 |
| Graphite | 5 to 50 |
| Molybdenum disulfide | 2 to 30 |
| Syntheitc oil | 10 to 70 |
| Mineral oil | 11 to 65 |
| Composition No. 8 | |
| Iron | 5 to 30 |
| Copper | 10 to 70 |
| Aluminum | 10 to 70 |
| Nickel | 10 to 80 |
| Oil-water soluble | 5 to 50 |
| Water | 10 to 35 |
| Composition No. 9 | |
| Copper | 10 to 85 |
| Aluminum | 10 to 60 |
| Borax | 5 to 30 |
| Boron nitrite | 10 to 80 |
| Silver sulfate | 5 to 35 |
| Tungsten disulfide ($WS_2$) | 5 to 80 |
| Petroleum distillates | 10 to 80 |
| Composition No. 10 | |
| Copper (Cu) | 7 |
| Aluminum (Al) | 5 |
| Iron (Fe) | 4 |
| Nickel (Ni) | 10 |
| Graphite | 4 |
| Paraffin base oil | 50 |
| Phenyl polysiloxane | 2 |
| Synthetic oil-carbon free | 8 |

Composition No. 1 is highly concentrated in nickel and is used as the initial application on iron parts. Compound No. 2 is less concentrated than Compound No. 1 and is used to reenforce the film formed by Compound No. 1. Compound No. 10 is used for relubrication in hostile environments.

Tested characteristics of the compositions is set out in the following table:

| Characteristic | Composition No. 1 | Composition No. 2 | Composition No. 10 |
|---|---|---|---|
| Volatility | 60% of silicone oil up | | |

-continued

| Characteristic | Composition No. 1 | Composition No. 2 | Composition No. 10 |
|---|---|---|---|
| Viscosity Temperature | to 500° C. very good | SAE 50 approximately at point of trickle (300° C.) | SAE 90 at 200° C. |
| Resistance to oxidation | good | 95% | excellent |
| Lubricating properties | excellent | excellent | excellent for ovens, mills and catherine wheels |
| Thermal stability | between medium and good | between good and medium | very good |
| Resistance to hydrolysis | very good | good | good |
| Resistance to fire | between average and good | average in vehicles | good |
| Solvent effect on effects rubber, varnishes, etc. | pronounced | average | average |
| Solubility in petrochemicals | good | 50% | good |
| Compatibil- with other additives | good | good | good |

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

I claim:

1. A lubricant, comprising:

between 35 and 95 parts by weight of nickel; and between 5 and 65 parts by weight of fluids selected from the group consisting of silicon oil, mineral oil, naphthenic oil, paraffinic oil, lithium soap, polyglycol, silicate esters, vegetable oil, and fluorides;

whereby said lubricant is a paste.

2. The lubricant defined in claim 1, wherein the portion of nickel is between 85 and 95 parts by weight;

said fluids are silicon oil; and the portion of silicon oil is between 5 and 15 parts by weight.

3. The lubricant defined in claim 1, wherein:

the portion of nickel is between 75 and 85 parts by weight;

said fluids are mineral oil and silicone oil;

the portion of mineral oil is between 10 and 20 parts by weight;

the portion of silicone oil is between 2 and 10 parts by weight.

4. The lubricant defined in claim 1, wherein:

a portion of nickel is between 65 and 55 parts by weight;

said fluids are lithium soap and naphthenic oil;

the portion of lithium soap is between 5 and 15 parts by weight; and the portion of naphthenic oil is between 5 and 15 parts by weight.

5. The lubricant defined in claim 1, wherein:

the portion of nickel is between 55 and 65 parts by weight;

said fluids are polyglycols and paraffinic oils;

the portion of polyglycol is between 15 and 25 parts by weight; and the portion of paraffinic oil is between 15 and 25 parts by weight.

6. The lubricant defined in claim 1, wherein:

the portion of nickel between 45 and 55 parts by weight;

said fluids are silicate esters and vegetable oil;

the portion of silicate ester is between 25 and 35 parts by weight; and a portion of vegetable oil is between 15 and 25 parts by weight.

7. The lubricant defined in claim 1, wherein:

the portion of nickel is between 35 and 45 parts by weight;

said fluids are fluorides; and the portion of fluorides is between 55 and 65 parts by weight.

8. A lubricant, comprising:

| Component | Percentage by weight |
|---|---|
| copper | 30 to 60 |
| nickel | 20 to 80 |
| graphite | 5 to 50 |
| molybdenum disulfide | 2 to 30 |
| synthetic oil | 10 to 70 |
| mineral oil | 11 to 65 |

whereby said lubricant is a paste.

9. A lubricant, comprising:

| Component | Percentage by weight |
|---|---|
| Iron | 5 to 30 |
| Copper | 10 to 70 |
| Aluminum | 10 to 70 |
| Nickel | 10 to 80 |
| Water-soluble oil | 5 to 50 |
| Water | 10 to 35 |

whereby said lubricant is a paste.

10. A lubricant, comprising:

| Component | Percentage by weight |
|---|---|
| Copper | 10 to 85 |
| Aluminum | 10 to 60 |
| Borax | 5 to 30 |
| Boron nitrite | 10 to 80 |
| Silver sulfate | 5 to 35 |
| Tungsten disulfide | 5 to 80 |
| Petroleum distillate | 10 to 80 |

whereby said lubricant is a paste.

11. A lubricant, comprising:

| Component | Percentage by weight |
|---|---|
| Copper | 5 to 10 |
| Aluminum | 3 to 8 |
| Iron | 2 to 6 |
| Nickel | 5 to 15 |
| Graphite | 2 to 6 |
| Paraffinic oil | 40 to 60 |
| Phenyl polysiloxane | 1 to 3 |
| Synthetic oil-carbon free | 5 to 10 |

whereby said lubricant is a paste.

12. A method of reducing friction between two relatively moving surfaces, comprising the step of:

applying to at least a portion of at least one of said surfaces a lubricant comprising:

between 35 and 95 parts by weight of nickel; and between 5 and 65 parts by weight of fluids selected from the group consisting of silicon oil, mineral oil, naphthenic oil, paraffinic oil, lithium soap, polyglycol, silicate esters, vegetable oil, and fluorides;

whereby said lubricant is a paste.

13. The method defined in claim 12, wherein:

the lubricant comprises the portion of nickel is between 85 and 95 parts by weight;

said fluids are silicon oil; and the portion of silicon oil is between 5 and 15 parts by weight.

14. The method defined in claim 13, wherein:

the portion of nickel is between 75 and 85 parts by weight;

said fluids are mineral oil and silicone oil;

the portion of mineral oil is between 10 and 20 parts by weight;

the portion of silicone oil is between 2 and 10 parts by weight.

* * * * *